US007935467B2

(12) United States Patent
Dojo et al.

(10) Patent No.: US 7,935,467 B2
(45) Date of Patent: May 3, 2011

(54) MAGNETIC TONER

(75) Inventors: Tadashi Dojo, Numazu (JP); Michihisa Magome, Mishima (JP); Eriko Yanase, Suntou-gun (JP); Takashi Matsui, Suntou-gun (JP); Tomohisa Sano, Suntou-gun (JP); Akira Sakakibara, Susono (JP); Shuichi Hiroko, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/272,976

(22) Filed: Nov. 18, 2008

(65) Prior Publication Data

US 2009/0130580 A1 May 21, 2009

(30) Foreign Application Priority Data

Nov. 21, 2007 (JP) ..... 2007-301428

(51) Int. Cl.
*G03G 15/01* (2006.01)

(52) U.S. Cl. ..... 430/106.1; 430/108.1

(58) Field of Classification Search ..... 430/106.1, 430/108.1

See application file for complete search history.

(56) References Cited

U.S. PATENT DOCUMENTS

| | | | | |
|---|---|---|---|---|
| 5,612,159 | A | 3/1997 | Sato et al. | 430/110 |
| 6,033,817 | A | 3/2000 | Yusa et al. | 430/106.6 |
| 6,524,762 | B2 | 2/2003 | Tsutsui et al. | 430/108.8 |
| 2001/0055501 | A1* | 12/2001 | Inoue et al. | 399/223 |
| 2002/0012551 | A1 | 1/2002 | Tsutsui et al. | 399/252 |
| 2009/0047043 | A1 | 2/2009 | Dojo et al. | 399/252 |

FOREIGN PATENT DOCUMENTS

| | | |
|---|---|---|
| JP | 59-168460 | 9/1984 |
| JP | 59-170847 | 9/1984 |
| JP | 1-204068 | 8/1989 |
| JP | 8-82949 | 3/1996 |
| JP | 10-97095 | 4/1998 |
| JP | 2000-29239 | 1/2000 |
| JP | 2001-235897 | 8/2001 |
| JP | 2001-356516 | 12/2001 |
| JP | 2003-43738 | 2/2003 |

* cited by examiner

*Primary Examiner* — Hoa V Le

(74) *Attorney, Agent, or Firm* — Fitzpatrick, Cella, Harper & Scinto

(57) ABSTRACT

In a magnetic toner which has magnetic toner base particles containing at least a binder resin and a magnetic material, and an inorganic fine powder, (i) the magnetic toner has an average circularity of from 0.950 or more to 1.000 or less, (ii) the magnetic toner has a compressibility of 30 or less, and (iii) the magnetic toner contains boron nitride particles having a median diameter (D50) of from 0.5 μm or more to 8.0 μm or less, as the inorganic fine powder in an amount of from 0.05 part by mass or more to 1.00 part by mass or less based on 100 parts by mass of the magnetic toner base particles. This provides a magnetic toner with which stable image density can be achieved without regard to service environment and which do not cause any image defects such as fog.

6 Claims, No Drawings

MAGNETIC TONER

BACKGROUND OF THE INVENTION

1. Field of the Invention

This invention relates to a magnetic toner used in recording processes making use of electrophotography, electrostatic recording, electrostatic printing or toner jet recording.

2. Description of the Related Art

In magnetic one-component developers, i.e., magnetic toners, used in jumping development, which is one of dry-process developing methods, proposals are made which are concerned with toners made to have a higher circularity in some ways (Japanese Patent Applications Laid-open No. H10-97095, No. 2000-029239 and No. 2001-235897). In the magnetic toners, making them have a higher circularity may be effective in making image quality higher and improving transfer efficiency on the one hand, but on the other hand may bring about difficulties stated below, in some electrophotographic performances. For one thing, the toner tends to faster come into closest packing, and hence magnetic toner particles may so highly rub together or rub against one another as to tend to cause problems of what is called toner deterioration, such that any treating agent added later externally to magnetic toner base particles may become buried in or liberated from toner particles and that the magnetic toner base particles may come to chip. With progress of such toner deterioration, the toner tends to change greatly in charge quantity, or cause image defects accompanied by the faulty charging that may come when any fine powder thereby produced sticks to a toner carrying member or to a toner control member.

To solve such problems, it is attempted to make an improvement by controlling the fluidity of the magnetic toner. For example, available are a magnetic toner in which the degree of agglomeration has been controlled (Japanese Patent Application Laid-open No. 2003-043738) and a magnetic toner the compressibility of which has been controlled (Japanese Patent Application Laid-open No. 2001-35.6516). Taking account of, e.g., adaptation to high-speed machines, however, there still remain problems on improvement in image quality and improvement in durability (running performance).

In addition, as a difficulty caused when the magnetic toner is made to have a higher circularity, a trouble tends to come about in a cleaning step in the electrophotographic process.

As a cleaning means, a blade cleaning means which is so set up that a cleaning blade made of a rubber elastic material is brought into pressure contact with the surface of a photosensitive member is commonly used because of its simple and compact construction and also its advantage in view of cost. This blade cleaning means has a superior cost performance on the one hand, but on the other hand tends to cause melt adhesion of toner to the photosensitive member because it is so set up that the cleaning blade is strongly brought into pressure contact with the photosensitive member surface. Further, it tends to cause faulty cleaning which is a phenomenon that the toner slips away through any slight gap(s) between the cleaning blade and the photosensitive member surface. Such problems may remarkably arise especially when the magnetic toner made to have a higher circularity is used.

With an aim to remedy these, it is proposed that the magnetic toner is incorporated therein with an inorganic fine powder as an abrasive or a lubricant. For example, it is disclosed to incorporate a conductive zinc oxide and tin oxide, or to incorporate cerium fluoride or fluorine-containing cerium oxide particles. (Japanese Patent Applications Laid-open No. S59-168460, S59-170847, No. H01-204068 and No. H08-082949). In these methods, however, such abrasive particles are non-uniform in their hardness and hence they may non-uniformly abrade the photosensitive member surface. Thus, because of a difference in coefficient of friction between the photosensitive member and the cleaning blade at abraded areas and unabraded areas, there have been tendencies that the blade tends to turn up and toner particles tend to slip away. Further, where the abrasive particles have large particle diameters and also have a broad particle size distribution, the abrasive particles must be added to the toner in a large quantity in order to abrade the photosensitive member surface uniformly. However, their addition in a large quantity tends to cause problems on developing performances (in particular, toner scatter, reversal fog, and accumulation of abrasive particles) Such difficulties have also been a matter of importance.

SUMMARY OF THE INVENTION

The present invention aims to provide a magnetic toner having resolved such problems as noted above.

Accordingly, an object of the present invention is to provide a magnetic toner with which stable image density can be achieved without regard to service environment and which does not cause any image defects such as fog.

An object of the present invention is to provide a magnetic toner which does not cause any problems such as faulty cleaning and melt adhesion of toner to photosensitive member.

The present inventors have discovered that the circularity and compressibility of the magnetic toner may be specified and at the same time boron nitride particles whose particle diameter has been controlled may be added to magnetic toner base particles and this enables achievement of both the high image quality and the stable cleaning performance. Thus, they have accomplished the present invention.

That is, the present invention is achieved by any of what are given as recited below.

(1) A magnetic toner which comprises magnetic toner base particles containing at least a binder resin and a magnetic material, and an inorganic fine powder;

(i) the magnetic toner having an average circularity of from 0.950 or more to 1.000 or less;

(ii) the magnetic toner having a compressibility of 30 or less which is found from the following expression (1):

$$\text{Compressibility}=\{1-(\text{apparent density}/\text{tap density})\}\times 100;\text{ and} \qquad \text{Expression (1)}$$

(iii) the magnetic toner containing boron nitride particles having a median diameter (D50) of from 0.5 μm or more to 8.0 μm or less, as the inorganic fine powder in an amount of from 0.05 part by mass or more to 1.00 part by mass or less based on 100 parts by mass of the magnetic toner base particles.

(2) The magnetic toner described in the above (1), which has a weight average particle diameter (D4) of from 4.0 μm or more to 9.0 μm or less, and has a ratio of weight average particle diameter (D4) to number average particle diameter (D1) of 1.25 or less.

(3) The magnetic toner described in the above (1), wherein the boron nitride particles have a median diameter (D50) of from 1.0 μm or more to 6.0 μm or less, and have a coefficient of variation of 70 or less.

(4) The magnetic toner described in the above (1), which contains at least the magnetic toner base particles, the boron nitride particles, and two types of inorganic oxides having different particle diameters.

(5) The magnetic toner described in the above (1), which contains at least the magnetic toner base particles, the boron nitride particles, and as inorganic oxides a hydrophobic silica having a specific surface area of from 100 $m^2/g$ to 300 $m^2/g$, in an amount of from 0.1 part by mass to 3 parts by mass based on 100 parts by mass of the magnetic toner base particles, and a metal oxide having a number average particle diameter of from 80 nm to 1 μm, in an amount of from 0.1 part by mass to 3 parts by mass based on 100 parts by mass of the magnetic toner base particles.

(6) The magnetic toner described in the above (1), which has a residual magnetization of 4.0 $Am^2/kg$ or less when magnetized in a magnetic field of 79.6 kA/m.

According to the present invention, in which the magnetic toner base particles and the external additive have been improved, the image density can be stable without regard to service environment and sharp images can be obtained.

Further features of the present invention will become apparent from the following description of exemplary embodiments with reference to the attached drawings.

DESCRIPTION OF THE EMBODIMENTS

The present invention is described below in detail.

In jumping development making use of the magnetic one-component developers, i.e., magnetic toners, and where the magnetic toner made to have a higher circularity is used, the following points are important in order to achieve high image quality and stable cleaning performance when toner is used under environmental variations or repeatedly. The points are to make toner coat level and charge quantity stable on a developing sleeve and to improve lubricity between the magnetic toner and a photosensitive drum.

As a result of extensive studies made by the present inventors, they have reached a finding that, to make toner coat level and charge quantity stable on the developing sleeve and to improve lubricity between the magnetic toner and the photosensitive drum, the both are achievable by controlling the compressibility of the magnetic toner and at the same time adding the boron nitride particles whose particle diameter has been controlled, thus they have accomplished the present invention.

First, in the present invention, the compressibility of magnetic toner is found from the following expression (1):

$$\text{Compressibility}=\{1-(\text{apparent density}/\text{tap density})\}\times 100 \qquad \text{Expression (1)}$$

This compressibility is the value calculated from the apparent density and tap density of the toner, and indicates the rate of changes in apparent density and tap density. In the vicinity of the developing sleeve, how the magnetic toner is agitated and how it is pressed against the developing sleeve vary depending on environmental changes, toner quantity left after use with time, and so forth. Especially in the case of the magnetic toner made to have a higher circularity, it tends to cause the problems of what is called toner deterioration, such that any treating agent added later externally to magnetic toner base particles may become buried in or liberated from toner particles and that the magnetic toner base particles may come to chip. Hence, for such variations, the toner coat level and charge quantity on the developing sleeve tend to become unstable. The compressibility of the magnetic toner serves as an index that estimates the stability of the coat level and charge quantity of the magnetic toner on the developing sleeve against such variations.

In the present invention, the magnetic toner is required to have a compressibility of 30 or less. If it has a compressibility of more than 30, it may change in condition in the vicinity of the developing sleeve so greatly that the coat level and charge quantity of the magnetic toner may tend to become unstable on the developing sleeve. Stated specifically, changes in toner coat layer on the developing sleeve tend to cause image density variations and image defects such as fog.

As examples of a method for controlling such compressibility of the toner, it may include the following methods (A) to (D). These methods may each be employed alone, or may be carried out in combination of some methods.

(A) A method in which the particle shape (average circularity) and particle surface smoothness of the magnetic toner are improved to reduce the area of contact between toner particles.

(B) A method in which the particle size distribution of the magnetic toner is made proper to control the content of fine powder and coarse powder to control packing characteristics.

(C) A method in which a plurality of kinds of organic or inorganic fine-particle layers whose surface energy, hydrophobicity, particle size and so forth have been made proper are made to adhere to magnetic toner particle surfaces.

(D) A method in which the magnetic properties of the magnetic toner are made proper to make it less magnetically agglomerative.

In the present invention, the magnetic toner contains boron nitride particles having a median diameter (D50) of from 0.5 μm or more to 8.0 μm or less, in an amount of from 0.05 part by mass or more to 1.00 part by mass or less based on 100 parts by mass of the magnetic toner base particles.

The boron nitride particles used in the present invention have crystal structure of a hexagonal system. This structure resembles that of graphite, where particles stand interlaminar-bonded by van der Waals force and therefore are readily slidable one another. Hence, they are characteristic of high lubricity and releasability. In addition, different from the graphite, the boron nitride particles have a high electrical resistance.

The boron nitride particles having such characteristics are made to adhere to the surfaces of the magnetic toner base particles the compressibility of which has been controlled. This for one thing weakens the agglomerative force between toner particles to bring a remarkable improvement in stress resistance. Also, because of their high electrical resistance as being different from the graphite, the boron nitride particles may less affect the charge quantity of toner and hence can stabilize the chargeability of toner on the developing sleeve. Still also, the boron nitride particles make the toner less adherent to the developing sleeve and hence enable the developing sleeve to be less stained even in its repeated service.

In the cleaning part, the boron nitride particles come present between a cleaning member and the photosensitive member, and this provides that part with lubricity, so that stable cleaning can be achieved even when the magnetic toner made to have a higher circularity is used. Also, in combination with the magnetic toner the compressibility of which has been controlled to 30 or less, the agglomerative force between toner particles can be made always constant to bring a dramatic improvement in cleaning performance.

In the present invention, the boron nitride particles have a median diameter (D50) of from 0.5 μm or more to 8.0 μm or less, and may preferably have a median diameter (D50) of from 1.0 μm or more to 6.0 μm or less and a coefficient of variation of 70 or less. If the boron nitride particles have a median diameter (D50) of less than 0.5 μm, the toner may have low lubricity and releasability to come low adherent to the developing sleeve and low stable in the cleaning part. If on the other hand the boron nitride particles have a median diameter (D50) of more than 8.0 μm and have a coefficient of variation of more than 70, the boron nitride particles may come liberated from the magnetic toner base particles in so large a proportion that the boron nitride particles having come liberated may adhere to the developing sleeve and to the photosensitive member itself to come to inhibit the triboelectric charging between the magnetic toner and the developing sleeve. Further, the toner may change in its fluidity at the part where it has adhered to the cleaning blade, and this may make the photosensitive member abraded locally to tend to cause slip-away at the cleaning part.

In the present invention, the boron nitride particles may be produced by a known method. For example, the boron nitride particles may be produced by (1) a method in which boric acid, boric anhydride, borax or the like is heated in an atmosphere of ammonia gas or nitrogen gas, and (2) a method in which such a boric derivative and a nitrogen-containing compound such as melamine, urea or guanidine are mixed and thereafter the mixture obtained is heated in an atmosphere of a reducing gas such as ammonia, nitrogen, argon or helium or an inert or non-oxidative gas. In the present invention, it is preferable that the powder obtained is appropriately size-controlled by means of an air classifier or the like to make it have the particle diameter and particle size distribution specified in the present invention.

In the present invention, the magnetic toner has an average circularity of from 0.950 or more to 1.000 or less, and preferably from 0.960 or more. This is because for one thing, in the magnetic toner, the fact that it has a high average circularity makes it easy to make charge quantity distribution of the toner uniform on the developing sleeve. Hence, if the magnetic toner has a low average circularity outside this range, it tends to cause problems such as a decrease in image density and a lowering of image quality.

The magnetic toner of the present invention may also preferably have a weight average particle diameter (D4) of from 4.0 μm or more to 9.0 μm or less. If the magnetic toner has a weight average particle diameter (D4) of more than 9.0 μm, minute dote images may come low reproducible. If on the other hand the magnetic toner has a weight average particle diameter (D4) of less than 4.0 μm, the toner may have a large specific surface area to have so high agglomerative force between toner particles that it may tend to cause problems such as image density decrease and image defects. What more remarkably brings about the effect of, e.g., improving the charging stability and fluidity in the magnetic toner of the present invention is a case in which it has the weight average particle diameter (D4) of from 4.0 μm or more to 9.0 μm or less, and further, in view of achievement of much higher image quality, may preferably have a weight average particle diameter (D4) of from 5.0 μm or more to 8.0 μm or less.

The magnetic toner of the present invention may preferably have a ratio of weight average particle diameter (D4) to number average particle diameter (D1) of 1.25 or less. If this ratio is more than 1.25, i.e., the magnetic toner has a broad particle size distribution, it may be difficult to control the compressibility to tend to make physical properties of the toner unstable on the developing sleeve. The proportion of the boron nitride particles adhering to the magnetic toner base particles may also become non-uniform, so that the toner may tend to come to slip away at the cleaning part and melt-adhere to the photosensitive member.

In the present invention, further, the controlling of magnetic properties of the magnetic toner makes the intended effect obtainable with ease. The magnetic toner may have a residual magnetization of 4.0 $Am^2/kg$ or less when magnetized in a magnetic field of 79.6 kA/m. This can make the magnetic toner less magnetically agglomerative, thus the compressibility can be made proper with ease.

How to produce the magnetic toner in the present invention is described next.

The magnetic toner of the present invention may be produced by any known method. In particular, a polymerization process which produces toners in a wet medium by dispersion polymerization, association agglomeration or suspension polymerization is preferred because the particle shape and particle surface properties of the magnetic toner can be controlled with ease and the physical properties of the magnetic toner of the present invention can be attained with ease. In particular, suspension polymerization is especially preferred.

As an example of the production process, how to produce the magnetic toner base particles by suspension polymerization is described here. In the suspension polymerization, components necessary as magnetic toner base particles, such as a magnetic iron oxide, a colorant, a release agent, a plasticizer, a binder, a charge control agent and a cross-linking agent, and other additives as exemplified by an organic solvent used in order to lower the viscosity of a polymer produced by polymerization reaction, a dispersant and so forth are appropriately adding to a polymerizable monomer, and these are uniformly dissolved or dispersed by means of a dispersion machine such as a homogenizer, a ball mill, a colloid mill or an ultrasonic dispersion machine. The monomer system (polymerizable monomer composition) thus obtained is suspended in an aqueous medium containing a dispersion stabilizer.

Here, a high-speed dispersion machine such as a high-speed stirrer or an ultrasonic dispersion machine may be used to make the toner particles have the desired particle size at a stretch. This can more make the resultant toner base particles have a sharp particle size distribution. As the time at which a polymerization initiator is added, it may be added simultaneously when other additives are added to the polymerizable monomer, or may be mixed immediately before the polymerizable monomer composition is suspended in the aqueous medium. Also, a polymerization initiator having been dissolved in the polymerizable monomer or in a solvent may be added immediately after granulation and before the polymerization reaction is initiated.

After the granulation, agitation may be carried out using a usual agitator in such an extent that the state of particles is maintained and also the particles can be prevented from floating and settling.

In the suspension polymerization, any known surface-active agents or organic or inorganic dispersants may be used as dispersion stabilizers. In particular, the inorganic dispersants may hardly cause any ultrafine powder and they attain dispersion stability on account of their steric hindrance. Hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

When these inorganic dispersants are used, they may be used as they are. In order to obtain finer particles, particles of the inorganic dispersant may be formed in the aqueous medium. For example, in the case of calcium phosphate, an aqueous sodium phosphate solution and an aqueous calcium chloride solution may be mixed under high-speed agitation, whereby water-insoluble calcium phosphate can be formed and more uniform and finer dispersion can be made. Here, water-soluble sodium chloride is simultaneously formed as a by-product. However, the presence of such a water-soluble salt in the aqueous medium keeps the polymerizable monomer from dissolving in water to make any ultrafine toner particles not easily formed by emulsion polymerization, and hence this is more favorable. Since, however, this water-soluble sodium chloride may be an obstacle when residual polymerizable monomers are removed at the termination of polymerization reaction, it is better to exchange the aqueous medium or desalt it with an ion-exchange resin. The inorganic dispersant can substantially completely be removed by dissolving it with an acid or an alkali after the polymerization is completed.

Any of these inorganic dispersants may preferably be used in an amount of from 0.2 part by mass to 20 parts by mass based on 100 parts by mass of the polymerizable monomer.

Where magnetic toner base particles made fine-particle are intended, a surface-active agent may be used in combination in an amount of from 0.001 to 0.1 part by mass. Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

In the step of polymerization, the polymerization may be carried out at a polymerization temperature set at 40° C. or above, and commonly at a temperature of from 50° C. to 90° C. When polymerization is carried out within this temperature range, the release agent to be enclosed inside the toner particles comes deposited by phase separation to come enclosed more perfectly. In order to consume residual polymerizable monomers, the reaction temperature may be raised to 90° C. to 150° C. if it is done at the termination of polymerization reaction.

In the present invention, in order to control the particle shape and particle surface properties of the magnetic toner, it is preferable to make adjustment by introducing water vapor into a polymer dispersion containing the magnetic toner base particles obtained.

The polymerizable monomer making up the polymerizable monomer composition used in the present invention may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides.

Any of these polymerizable monomers may be used alone or in the form of a mixture. Of the foregoing polymerizable monomers, styrene or a styrene derivative may preferably be used alone or in the form of a mixture with other monomer. This is preferable in view of developing performance and running performance of the magnetic toner.

In producing the magnetic toner of the present invention by polymerization, a polymerization initiator having a half-life of from 0.5 hour to 30 hours may be added at the time of polymerization reaction, in an amount of from 0.5 part by mass to 20 parts by mass based on 100 parts by mass of the polymerizable monomer, to carry out polymerization. This enables production of a polymer having a maximum molecular weight in the region of molecular weight of from 10,000 to 100,000, and enables the toner to be endowed with a desirable strength and appropriate melt properties. As example of the polymerization initiator, it may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide.

In the present invention, a cross-linking agent may be added, which may preferably be added in an amount of from 0.001 to 15% by mass based on the polymerizable monomer.

As the magnetic material used in the magnetic toner of the present invention, any conventionally known magnetic material may be used. The magnetic material to be incorporated in the magnetic toner base particles may include iron oxides such as magnetite, maghemite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

Stated specifically, it may include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). In the present invention, at least magnetic iron oxide may be contained as the magnetic material, and one or two or more of other materials may optionally be selected and used.

Such a magnetic iron oxide may preferably have a BET specific surface area, as measured by nitrogen gas absorption, of from 2 to 30 $m^2/g$, and particularly from 3 to 28 $m^2/g$, and also may preferably have a Mohs hardness of from 5 to 7.

As the particle shape of the magnetic iron oxide, it may be, e.g., octahedral, hexahedral, spherical, acicular or flaky. Octahedral, hexahedral or spherical ones are preferred as having less anisotropy, which are preferable in order to improve image density. Such particle shapes of the magnetic material may be ascertained by SEM or the like.

The magnetic iron oxide may preferably have a number average particle diameter of from 0.1 μm to 0.3 μm and have particles of from 0.03 μm to 0.1 μm in diameter in a content of 40% by number or less, in the measurement of particle size in respect of particles having particle diameters of 0.03 μm or more.

If images are obtained using a magnetic toner making use of a magnetic iron oxide having a number average particle diameter of less than 0.1 μm, the tint of images may shift to a red tint to come insufficient in blackness of the images, or, in halftone images, the images may strongly tend to be strongly felt reddish, as being commonly undesirable. Also, such a magnetic iron oxide has so large a surface area as to come low dispersible to bring about an increase in energy required at the time of production. This is not efficient. Still also, such a magnetic iron oxide may come weakly effective as a colorant to make images insufficient in density in some cases, undesirably.

On the other hand, if the magnetic iron oxide has a number average particle diameter of more than 0.3 μm, it has a large mass per particle, and hence this is undesirable because it may come bare to toner particle surfaces in a high probability under the influence of a difference in gravity from that of the binder at the time of production, or because there may be a high possibility that a production apparatus wears greatly, or because a dispersion system may come low in sedimentation stability.

If in the magnetic toner base particles the magnetic iron oxide has particles of 0.1 μm or less in diameter in a content of more than 40% by number, such fine magnetic iron oxide particles have so large a surface area as to come low dispersible to bring about high possibilities of tending to cause agglomerates in the magnetic toner base particles to damage the chargeability of the magnetic toner and lowering its coloring power. Hence, such particles may be in a content of 40% by number or less. Further, where the magnetic iron oxide has such particles in a content of 30% by number or less, such a magnetic iron oxide is preferred because the above possibilities can be made lower.

A magnetic iron oxide of less than 0.03 μm in particle diameter may undergo a small stress when the magnetic toner base particles are produced, because of the fact that it has small particle diameter, and hence it may come bare to toner particle surfaces in a low probability. Further, even where it has come bare to toner particle surfaces, it may little act as leak sites to come into substantially no problem. Accordingly, in the present invention, it takes note of the content of particles of 0.03 μm or more in diameter, and defines its percent (%) by number.

In the present invention, it is also preferable for the magnetic iron oxide that, in its fine particles, particles of 0.3 μm or more in diameter are in a content of 10% by number or less. If such particles are in a content of more than 10% by number, the magnetic toner may have a low coloring power, tending to result in a lowering of image density. In addition thereto, even if the magnetic iron oxide is used in the same quantity, the number of its particles is so small as to make it difficult as a matter of probability to make the magnetic iron oxide present up to the vicinities of the surfaces of magnetic toner base particles and also incorporate it in the magnetic toner base particles in a uniform number of particles. Thus, such content is undesirable. More preferably, the particles of 0.3 μm or more in diameter may be in a content of 5% by number or less.

This magnetic iron oxide may preferably be one having a coercive force of from 1.5 kA/m to 12 kA/m, a saturation magnetization of from 30 $Am^2/kg$ to 120 $Am^2/kg$ (preferably from 40 $Am^2/kg$ to 80 $Am^2/kg$) and a residual magnetization of from 1 $Am^2/kg$ to 10 $Am^2/kg$, as magnetic properties under application of a magnetic field of 79.58 kA/m (1 kOe). The magnetic properties of the magnetic material may be measured with a vibration type magnetic-force meter, e.g., VSM P-1-10 (manufactured by Toei Industry Co., Ltd.) at 25° C. under application of an external magnetic field of 79.6 kA/m.

In the present invention, the magnetic properties and amount of the magnetic material to be added may preferably be so controlled that the magnetic toner may have a residual magnetization of 4.0 $Am^2/kg$ or less under application of a magnetic field of 79.58 kA/m (1 kOe).

In the case when the magnetic toner base particles in the present invention are produced by polymerization, the fine magnetic iron oxide particles used as the magnetic material may preferably be those having been subjected to hydrophobic treatment. The controlling of this hydrophobic treatment enables strict control of the state of presence of the magnetic iron oxide in the magnetic toner base particles. For example, the particle surfaces of the magnetic iron oxide may be treated with a coupling agent.

As a method for treating the magnetic iron oxide particle surfaces with the coupling agent, two methods are available which are dry-process treatment and wet-process treatment. In the present invention, the treatment may be carried out by either method. The method of wet-process treatment, carried out in an aqueous medium, is preferred because it may less cause the mutual coalescence of magnetic iron oxide particles than the dry-process treatment, carried out in a gaseous phase, and also charge repulsion acts between magnetic iron oxide particles themselves as a result of hydrophobic treatment, so that the magnetic material particles can be surface-treated with the coupling agent substantially in the state of primary particles.

The coupling agent usable in the surface treatment of the magnetic iron oxide in the present invention may include, e.g., a silane coupling agent and a titanium coupling agent. What is more preferably usable is a silane coupling agent, which is a compound represented by the following general formula (A):

$$R_mSiY_n \quad (A)$$

wherein R represents an alkoxyl group; m represents an integer of 1 to 3; Y represents an alkyl group, a vinyl group, a methacrylic group, a phenyl group, an amino group, an epoxy group, a mercapto group or a derivative of any of these; and n represents an integer of 1 to 3.

It may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

In particular, the magnetic iron oxide particle surfaces may be hydrophobic-treated with an alkyltrialkoxysilane coupling agent represented by the following formula (B):

$$C_pH_{2p+1}—Si—(OC_qH_{2q+1})_3 \quad (B)$$

wherein p represents an integer of 2 to 20, and q represents an integer of 1 to 3.

In the above formula, if p is smaller than 2, though hydrophobic treatment may be carried out with ease, it may be difficult to provide a sufficient hydrophobic nature. If p is larger than 20, though hydrophobic nature can be sufficient, the magnetic iron oxide particles may greatly coalesce one another to make it difficult to disperse the magnetic iron oxide sufficiently in the magnetic toner base particles. Also, if q is larger than 3, the silane coupling agent may have a low reactivity to make it difficult for the magnetic iron oxide to be made sufficiently hydrophobic.

Accordingly, it is preferable to use an alkyltrialkoxysilane coupling agent in which, in the above formula, the p represents an integer of 2 to 20 (more preferably an integer of 3 to 15) and the q represents an integer of 1 to 3 (more preferably an integer of 1 or 2). In the treatment, the silane coupling agent may be used in an amount of from 0.05 part by mass to 20 parts by mass, and preferably from 0.1 part by mass to 10 parts by mass, based on 100 parts by mass of the fine magnetic iron oxide particles having not been treated.

In the present invention, as a method by which the hydrophobicity of the magnetic iron oxide is controlled, it may include a method in which the magnetic iron oxide is treated with two or more types of silane coupling agents which differ in the p in the above silane coupling agent. The types of such silane coupling agents and the proportion of the amounts in which the magnetic iron oxide is to be treated therewith may appropriately be controlled, whereby a magnetic iron oxide can be obtained which has distribution in the degree of hydrophobic treatment.

To carry out treatment with the coupling agent in an aqueous medium as the surface treatment of the magnetic iron oxide, a method is available in which the magnetic iron oxide and coupling agent in suitable quantities are stirred in the aqueous medium.

The aqueous medium is meant to be a medium composed chiefly of water. Stated specifically, the aqueous medium may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred. The surface-active agent may be added in an amount of from 0.1% by mass to 5% by mass based on the water. The pH adjuster may include inorganic acids such as hydrochloric acid.

The stirring may be carried out by using, e.g., a mixing machine having a stirring blade (stated specifically, a high-shear force mixing machine such as an attritor or a TK homomixer), which may sufficiently be so carried out that fine iron oxide particles may come into primary particles in the aqueous medium.

The magnetic iron oxide thus obtained has uniformly been hydrophobic-treated on its particle surfaces, and hence is very well dispersible in the polymerizable monomer composition. Thus, magnetic toner base particles can be obtained the content of the magnetic iron oxide in which stands uniform.

The magnetic iron oxide used in the magnetic toner of the present invention may be produced in the following way, for example.

To an aqueous ferrous salt solution such as an aqueous ferrous sulfate solution, an alkali such as sodium hydroxide is added in an equivalent weight, or more than equivalent weight, with respect to the iron component to prepare an aqueous solution containing ferrous hydroxide. Into the aqueous solution thus prepared, air is blown while its pH is maintained at pH 7 or above (preferably a pH of 8 to 10), and the ferrous hydroxide is made to undergo oxidation reaction while the aqueous solution is heated at 70° C. or more to firstly form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 6 to 10 and air is blown, to cause magnetic iron oxide particles to grow about the seed crystals as cores. With progress of oxidation reaction, the pH of the liquid comes to shift to acid side, but it is preferable for the pH of the liquid to be so adjusted as not to be made less than 6. At the termination of the oxidation reaction, the pH is adjusted, and the liquid is thoroughly stirred so that the magnetic iron oxide particles become primary particles. Then the coupling agent is added, and the mixture obtained is thoroughly mixed and stirred, followed by filtration, drying, and then light disintegration to obtain magnetic iron oxide particles having been hydrophobic-treated. Instead, the iron oxide particles obtained after the oxidation reaction is completed, followed by washing and filtration, may be again dispersed in a different aqueous medium without drying, and thereafter the pH of the dispersion again formed may be adjusted, where a silane coupling agent may be added with thorough stirring, to make coupling treatment.

At any event, it is preferable that the untreated magnetic iron oxide formed in the aqueous solution is made hydrophobic in the state of a water-containing slurry having not gone through the drying step. This is because, if the untreated magnetic iron oxide is dried as it is, the particles may unavoidably mutually agglomerate to come to coalesce and, even if the powder standing thus agglomerate is subjected to the wet-process hydrophobic treatment, it is difficult to carry out any uniform hydrophobic treatment.

As the ferrous salt used in the aqueous ferrous salt solution when the magnetic iron oxide is produced, it is possible to use iron sulfate commonly formed as a by-product in the manufacture of titanium by the sulfuric acid method, or iron sulfate formed as a by-product as a result of surface washing of steel sheets. Besides ferrous sulfate, it is possible to use iron chloride or the like.

In the process of producing the magnetic iron oxide by the aqueous-solution method, commonly in order to prevent viscosity from increasing at the time of reaction and in view of the solubility of the iron sulfate, an aqueous ferrous sulfate solution is used in an iron concentration of from 0.5 to 2 mol/l. Commonly, the lower the concentration of iron sulfate is, the finer particle size the products tend to have. Also, in the reaction, the more the air is and the lower the reaction temperature is, the finer particles tend to be formed.

In the present invention, it is preferable to use the hydrophobic magnetic iron oxide thus produced.

The magnetic iron oxide used in the magnetic toner of the present invention may preferably be used in an amount of from 10 to 200 parts by mass, more preferably from 20 to 180 parts by mass, and still more preferably from 40 to 160 parts by mass, based on 100 parts by mass of the binder resin. If the magnetic iron oxide is in a content of less than 10 parts by mass, the magnetic toner may have a poor coloring power, and also may make it difficult to keep fog from occurring. If on the other hand it is in a content of more than 200 parts by mass, not only the magnetic toner may be held on the toner carrying member by magnetic force so strongly as to have a low developing performance or it may be difficult for the magnetic iron oxide to be uniformly dispersed in individual magnetic toner base particles, but also the magnetic toner to be obtained may have a low fixing performance.

In the present invention, the polymerization may be carried out by adding a resin to the polymerizable monomer composition. For example, a monomer component containing a hydrophilic functional group such as an amino group, a carboxylic group, a hydroxyl group, a sulfonic acid group, a glycidyl group or a nitrile group, which can not be used because it is water-soluble as a monomer and hence dissolves in an aqueous suspension to cause emulsion polymerization, should be introduced into toner base particles, it may be used in the form of a copolymer such as a random copolymer, a block copolymer or a graft copolymer, of any of these with a vinyl compound such as styrene or ethylene, in the form of a polycondensation product such as polyester or polyamide, or in the form of a polyaddition polymer such as polyether or polyimine. Where the high polymer containing such a polar functional group is made present together in the magnetic toner base particles, the release agent (wax component) can be made phase-separated and more strongly enclosed in particles, and hence a magnetic toner can be obtained which has good anti-offset properties, anti-blocking properties and low-temperature fixing performance. Such a high polymer may preferably be used in an amount of from 1 to 20 parts by weight based on 100 parts by weight of the polymerizable monomer. Its use in an amount of less than 1 part by weight may be low effective. On the other hand, its use in an amount of more than 20 parts by weight may make it difficult to design various physical properties of the polymerization toner.

As the high polymer containing such a polar functional group, one having an average molecular weight of 3,000 or more may preferably be used. If it has an average molecular weight of less than 3,000, especially 2,000 or less, the polymer tends to concentrate in the vicinity of the surfaces of toner particles, and hence it tends to adversely affect developing performance and anti-blocking properties, undesirably. A polymer having a molecular weight different from the range of molecular weight of the resin obtained by polymerizing the polymerizable monomer may also be dissolved to carry out polymerization. This enables production of a magnetic toner having a broad molecular weight distribution and high anti-offset properties.

In the magnetic toner of the present invention, it is preferable to add a polyester resin as the resin added to the polymerizable monomer.

A case in which the magnetic toner of the present invention is produced by a pulverization process is described next.

A method is preferred in which the binder resin, the magnetic material and optionally other additives are thoroughly mixed by means of a mixing machine such as a Henschel mixer or a ball mill, then the mixture is melt-kneaded by means of a heat kneading machine such as a kneader or an extruder to make resins melt one another, the melt-kneaded product obtained is cooled to solidify, thereafter the solidified product is pulverized, and the pulverized product is classified to obtain magnetic toner base particles. The magnetic toner base particles thus obtained and an external additive(s) may optionally thoroughly be mixed by means of a mixing machine such as Henschel mixer to obtain the magnetic toner of the present invention.

In producing the magnetic toner of the present invention, the classification may be carried out at any time after the formation of magnetic toner base particles. For example, it may be carried out after the toner base particles have been mixed with the external additive(s).

As apparatus used for the production of the magnetic toner by pulverization, examples of apparatus commonly usable are shown below. Examples are by no means limited to these. Examples of Pulverizer for Toner Production, Examples of Classifier for Toner Production, Examples of Sifter for Toner Production, Examples of Mixing Apparatus for Toner Production and Examples of Kneading Apparatus for Toner Production are given in Tables 1, 2, 3, 4 and 5, respectively.

TABLE 1

Examples of Pulverizer for Toner Production

| Name of apparatus | Manufacturer |
|---|---|
| Counter Jet Mill | Hosokawa Micron Corporation |
| Micron Jet | Hosokawa Micron Corporation |
| IDS-type Mill | Nippon Pneumatic MFG. Co., Ltd. |
| PJM Jet Grinding Mill | Nippon Pneumatic MFG. Co., Ltd. |
| Cross Jet Mill | Kurimoto, Ltd. |
| Ulmax | Nisso Engineering Co., Ltd. |
| SK Jet O-Mill | Seishin Enterprise Co., Ltd. |
| Criptron | Kawasaki Heavy Industries, Ltd. |
| Turbo Mill | Turbo Kogyo Co., Ltd. |
| Inomizer | Hosokawa Micron Corporation |

TABLE 2

Examples of Classifier for Toner Production

| Name of apparatus | Manufacturer |
|---|---|
| Classyl | Seishin Enterprise Co., Ltd. |
| Micron Classifier | Seishin Enterprise Co., Ltd. |
| Spedic Classifier | Seishin Enterprise Co., Ltd. |
| Turbo Classifier | Nisshin Engineering Inc. |
| Micron Separator | Hosokawa Micron Corporation |
| Turboprex(ATP) | Hosokawa Micron Corporation |
| TSP Separator | Hosokawa Micron Corporation |
| Elbow-Jet | Nittestsu Mining Co., Ltd. |
| Dispersion Separator | Nippon Pneumatic MFG. Co., Ltd. |
| YM Microcut | Yasukawa Shoji K.K. |

TABLE 3

Examples of Sifter for Toner Production

| Name of apparatus | Manufacturer |
|---|---|
| Ultrasonics | Koei Sangyo Co., Ltd. |
| Rezona Sieve | Tokuju Corporation |
| Vibrasonic Sifter | Dulton Company Limited |
| Sonicreen | Shinto Kogio Co., Ltd. |
| Gyro Sifter | Tokuju Corporation |
| Circular vibration sifters | many manufacturers |
| Turbo-Screener | Turbo Kogyo Co., Ltd. |
| Microsifter | Makino mfg. co., ltd. |

TABLE 4

Examples of Mixing Apparatus for Toner Production

| Name of apparatus | Manufacturer |
|---|---|
| Henschel Mixer | Mitsui Mining & Smelting Co., Ltd. |
| Super Mixer | Kawata MFG Co., Ltd. |
| Conical Ribbon Mixer | Y. K. Ohkawara Seisakusho |
| Nauta Mixer | Hosokawa Micron Corporation |
| Spiral Pin Mixer | Pacific Machinery & Engineering Co., Ltd. |
| Rhedige Mixer | Matsubo Corporation |
| Turbulizer | Hosokawa Micron Corporation |
| Cyclomix | Hosokawa Micron Corporation |

TABLE 5

Examples of Kneading Apparatus for Toner Production

| Name of apparatus | Manufacturer |
|---|---|
| KRC Kneader | Kurimoto, Ltd. |
| Buss Kneader | Coperion Buss Ag. |
| TEM-type Extruder | Toshiba Machine Co., Ltd. |
| TEX Twin-screw Extruder | The Japan Steel Works, Ltd. |
| PCM Kneader | Ikegai, Ltd. |
| Three-Roll Mill | Inoue Manufacturing Co., Ltd. |
| Mixing Roll Mill | Inoue Manufacturing Co., Ltd. |
| Kneader | Inoue Manufacturing Co., Ltd. |
| Kneadex | Mitsui Mining & Smelting Co., Ltd. |
| MS-type Pressure Kneader | Moriyama Manufacturing Co., Ltd. |
| Kneader-Ruder | Moriyama Manufacturing Co., Ltd. |
| Banbury Mixer | Kobe Steel, Ltd. |

In the present invention, in order to control the compressibility of the magnetic toner obtained by pulverization, a method is preferred in which the particles obtained are subjected to shape and surface modification of the magnetic toner base particles by means of an apparatus which blows high-temperature hot air instantaneously to the toner base particles and immediately thereafter cools the toner base particles with cold air. In modifying the surfaces of the magnetic toner base particles in this way, any excess heat is by no means applied to the toner base particles, and hence the surface modification of toner base particles can be effected while preventing raw-material components from changing in properties. Also, since the particles are instantaneously cooled, it by no means comes about that the toner base particles coalesce mutually in excess to come to greatly differ in toner particle diameter from that of toner base particles having not been subjected to the surface modification, and hence the physical properties of toner base particles having been subjected to the surface modification can readily be controlled also in the step of producing the toner. An apparatus which can carry out such surface modification may include, e.g., METEO RAINBOW (manufactured by Nippon Pneumatic Mfg. Co., Ltd.).

In the present invention, as a binder resin used when the magnetic toner base particles are produced by pulverization, it may include polyester resins, styrene-acrylic resins, hybrid resins containing a polyester resin component and a styrene-acrylic resin component, epoxy resins, styrene-butadiene resin, and polyurethane resins. Conventionally known resins may be used without any particular limitations. Of these, polyester resins and hybrid resins are particularly preferred in view of fixing performance.

Monomers for the polyester resin and polyester resin component used in the present invention may include the following.

As an alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (a), and a diol represented by the following Formula (b).

(a)

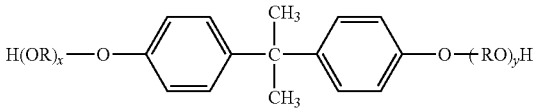

wherein R represents an ethylene group or a propylene group, x and y are each an integer of 1 or more, and an average value of x+y is 2 to 10.

(b)

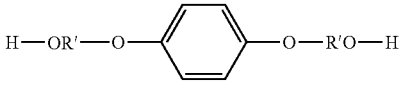

wherein R' represents —$CH_2CH_2$—,

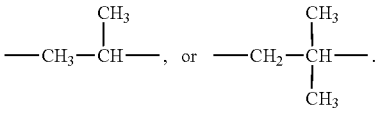

As a dibasic carboxylic acid, which may hold 50 mol % or more in the whole acid component, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or further succinic acid or its anhydride substituted with an alkyl group having 6 to 18 carbon atoms; and unsaturated dicarboxylic acids such as fumaric acid, maleic acid, citraconic acid and itaconic acid, or anhydrides thereof.

It may also include polyhydric alcohols such as glycerol, pentaerythritol, sorbitol, sorbitan, and also oxyalkylene ethers of, e.g., novolak phenol resins; and polybasic carboxylic acids such as trimellitic acid, pyromellitic acid and benzophenonetetracarboxylic acid, and anhydrides thereof.

Vinyl monomers for producing styrene-acrylic resins may include the following.

They may include styrene and derivatives thereof, such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyelene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acid anhydrides such as acrylic acid, methacrylic acid, crotonic acid and cinnamic acid; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

It may also optionally be a polymer cross-linked with a cross-linkable monomer which is as exemplified below.

The cross-linkable monomer may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol boron nitride particles #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene (4)-2,2-bis(4-hydroxyphenyl)propane diacrylate, and the above compounds whose acrylate moiety has been replaced with methacrylate; and polyester type diacrylates as exemplified by MANDA (trade name; available from Nippon Kayaku Co., Ltd.).

As a polyfunctional cross-linkable monomer, it may include pentaerythritol acrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.01 part by mass to 10 parts by mass, and more preferably from 0.03 part by mass to 5 parts by mass, based on 100 parts by mass of other monomer components.

Of these cross-linkable monomers, what may preferably be used in resins for toners in view of fixing performance and anti-offset properties may include the aromatic divinyl compounds (in particular, divinylbenzene) and the diacrylate compounds linked with a chain containing an aromatic group and an ether bond.

As a polymerization initiator used when the styrene-acrylic resin in the present invention is produced, it may include, e.g., azo compounds such as 2,2'-azobisisobutyronitrile, 2,2'-azobis(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis(1-cyclohexanecarbonitrile), 2-carbamoylazoisobutyronitrile, 2,2'-azobis (2,4,4-trimethylpentane), 2-phenylazo-2,4-dimethyl-4-methoxyvaleronitrile and 2,2'-azobis(2-methyl-propane); ketone peroxides such as methyl ethyl ketone peroxide, acetylacetone peroxide and cylcohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate and di-t-butyl peroxyazelate.

When the hybrid resin constituted of a polyester resin component and a styrene-acrylic resin component is synthesized, it is required to contain a monomer component capable of reacting with both the polyester resin component and the styrene-acrylic resin component. Among monomers constituting the polyester resin component, a monomer component capable of reacting with the styrene-acrylic resin component may include, e.g., unsaturated dicarboxylic acids such as fumaric acid, maleic acid, citraconic acid and itaconic acid, or anhydrides thereof. Among monomers constituting the styrene-acrylic resin component, a monomer component capable of reacting with the polyester resin component may include monomers having a carboxyl group or a hydroxyl group, and acrylates or methacrylates.

As a method for obtaining the hybrid resin, a method is preferred in which polymerization reaction for any one or both of the above polyester resin and styrene-acrylic resin is carried out in the state that a polymer is present which contains monomer components capable of respectively reacting with these resins.

In the present invention, the magnetic toner base particles may further optionally be incorporated with a release agent.

As the release agent usable in the magnetic toner of the present invention, it may include aliphatic hydrocarbon waxes such as low-molecular weight polyethylene, low-molecular weight polypropylene, microcrystalline wax and paraffin wax; oxides of aliphatic hydrocarbon waxes, such as polyethylene oxide wax, or block copolymers of these; waxes composed chiefly of a fatty ester, such as carnauba wax, sasol wax and montanate wax; those obtained by subjecting part or the whole of fatty esters to deoxidizing treatment, such as dioxidized carnauba wax; saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis (capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or acrylic acid to fatty acid hydrocarbon waxes; partially esterified products of polyhydric alcohols with fatty acids, such as monoglyceride behenate; methyl esterified products having a hydroxyl group, obtained by hydrogenation of vegetable fats and oils; and long-chain alkyl alcohols or long-chain alkyl carboxylic acids, which have 12 or more carbon atoms.

Release agents particularly preferably usable in the present invention may include aliphatic hydrocarbon waxes. Such aliphatic hydrocarbon waxes may include, e.g., low-molecular weight alkylene polymers obtained by polymerizing alkylenes by radical polymerization under high pressure or by polymerization under low pressure in the presence of a Ziegler catalyst; alkylene polymers obtained by thermal decomposition of high-molecular weight alkylene polymers; synthetic hydrocarbon waxes obtained from distillation residues of hydrocarbons obtained by the Arge process from synthetic gases containing carbon monoxide and hydrogen, and synthetic hydrocarbon waxes obtained by hydrogenation of the same; and any of these aliphatic hydrocarbon waxes fractionated by utilizing press sweating, solvent fractionation or vacuum distillation, or by a fractionation recrystallization system.

The hydrocarbon, serving as a matrix of the aliphatic hydrocarbon waxes, may include, e.g., those synthesized by reacting carbon monoxide with hydrogen in the presence of a metal oxide type catalyst (mostly catalysts of a two or more multiple system), as exemplified by hydrocarbons obtained by the Synthol method or the Hydrocol process (making use of a fluidized catalyst bed); hydrocarbons having up to about several hundred carbon atoms, obtained by the Arge process (making use of a fixed catalyst bed) which can obtain waxy hydrocarbons in a large quantity; and hydrocarbons obtained by polymerization of alkylenes such as ethylene in the presence of a Ziegler catalyst. Of these hydrocarbons, in the present invention, they may preferably be less- and small-branched, saturated long straight chain hydrocarbons. In particular, hydrocarbons synthesized by the method not relying on the polymerization of alkylenes are preferred in view of their molecular weight distribution.

In the present invention, the release agent may be so contained in the magnetic toner particles that an endothermic main peak may appear in the range of 50° C. to 90° C. in the DSC curve obtained when the magnetic toner particles containing the release agent are measured with a differential scanning calorimeter. This is preferable in view of low-temperature fixing performance and high-temperature anti-offset properties of the toner. If in DSC measurement the endothermic main peak is present in the range of less than 50° C., the wax component tends to come to exude to make the magnetic toner have a low storage stability. If on the other hand the endothermic main peak is present in the range of more than 90° C., the magnetic toner may have a high fixing temperature to tend to cause low-temperature offset, undesirably. Further, in the case when the magnetic toner base particles are directly produced by polymerization, a release agent having an endothermic main peak present in such a high temperature range is undesirable because a problem that, e.g., the wax component exudes during granulation may come about when it is added in a large quantity.

The endothermic peak temperature may be measured with a differential scanning calorimeter of a highly precise, inner-heat input compensation type as exemplified by DSC-7, manufactured by Perkin-Elmer Corporation, and according to ASTM D3418-82. The temperature at which the above peak appears may be controlled by using a release agent whose melting point, glass transition point and degree of polymerization have appropriately been controlled. Incidentally, the above DSC-7 may be used for measuring the peak temperature, and besides for measuring temperatures showing thermal physical properties of toner particles and toner particle materials, such as the glass transition point and softening point of the binder resin and the melting point of the wax.

As specific examples of the wax usable as the release agent in the present invention, it may include VISCOL® 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN® 350, 425, 550, 700, UNICID® 350, 425, 550, 700 (available from Toyo-Petrolite Co., Ltd.); and japan wax, bees wax, rice wax, candelilla wax, carnauba wax (available from CERARICA NODA Co., Ltd.).

In the present invention, the wax is required to be added in an amount so controlled that it may have a heat of fusion of 8 J/g or more in the magnetic toner. Stated specifically, it may preferably be incorporated in the magnetic toner base particles in an amount of 5% by mass or more, and more preferably 7% by mass or more.

The magnetic toner base particles of the present invention may be mixed with a charge control agent in its base particles in order to stabilize charge characteristics. As the charge control agent, any known agent may be used. In particular, a charge control agent is preferred which affords a high charging speed and can stably maintain a constant charge quantity.

Further, in the case when the toner base particles are directly produced by polymerization, particularly preferred are charge control agents having a low polymerization inhibitory action and substantially free of any solubilizate to the aqueous dispersion medium. As specific compounds, a negative charge control agent may include metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymer type compounds having a sulfonic acid or carboxylic acid group in the side chain; as well as boron compounds, urea compounds, silicon compounds, and carixarene. A positive charge control agent may include quaternary ammonium salts, polymer type compounds having such a quaternary ammonium salt in the side chain, guanidine compounds, Nigrosine compounds and imidazole compounds. Any of these charge control agents may preferably be used in an amount of from 0.5 part by mass to 10 parts by mass based on 100 parts by mass of the binder resin. However, the addition of the charge control agent is not essential in the magnetic toner of the present invention. The triboelectric charging between the toner and the toner layer thickness control member and developer carrying member may actively be utilized, and this makes it not always necessary for the toner to contain the charge control agent.

Stated more specifically, those preferable as agents for negative charging may include, e.g., Spilon Black TRH, T-77, T-95 (available from Hodogaya Chemical Co., Ltd.); and BONTRON (registered trademark) S-34, S-44, S-54, E-84, E-88, E-89 (available from Orient Chemical Industries Ltd.). Those preferable as agents for positive charging may include, e.g., TP-302, TP-415 (available from Hodogaya Chemical Co., Ltd.); BONTRON (registered trademark) N-01, N-04, N-07, P-51 (available from Orient Chemical Industries Ltd.), and Copy Blue PR (Klariant GmbH).

In the present invention, the fine magnetic iron oxide particles may be so used as to serve also as a colorant, but a colorant other than the fine magnetic iron oxide particles may also be used in combination. Such a colorant usable in combination may include magnetic or non-magnetic inorganic compounds and known dyes and pigments. Stated specifically, it may include, e.g., ferromagnetic metal particles of cobalt, nickel or the like, or particles of alloys of any of these metals to which chromium, manganese, copper, zinc, aluminum or a rare earth element has been added; as well as hematite particles, titanium black, nigrosine dyes or pigments, carbon black, and phthalocyanine. These may also be used after their particle surface treatment.

The magnetic toner of the present invention is used in the state that various materials according to the type of the toner are externally added to the toner particles (toner base particles), in addition to the boron nitride particles described above. As materials to be externally added in addition to the boron nitride particles, they may include external additives such as a fluidity improver for improving the fluidity of the toner, as exemplified by an inorganic fine powder, and a conductive fine powder for controlling the chargeability of the toner, such as a fine metal oxide powder.

The fluidity improver may include those which can improve the fluidity of the magnetic toner by its external addition to the magnetic toner base particles. Such a fluidity improver may include, e.g., fine silica powders such as wet-process silica and dry-process silica, as well as fine titanium oxide powder and fine alumina powder; and treated silica powder, treated titanium oxide powder and treated alumina powder which are obtained by subjecting the above powders to surface treatment with a silane coupling agent, a titanium coupling agent, a silicone oil or the like.

It is preferable for the fluidity improver to have a specific surface area of 30 $m^2/g$ or more as measured by the BET method, utilizing nitrogen gas absorption, and more preferably have a specific surface area of 50 $m^2/g$ or more, and still more preferably to be a hydrophobic-treated silica described below and having a specific surface area of from 100 to 300 $m^2/g$. The fluidity improver may preferably be mixed in an amount of, e.g., which may differ depending on the type of the fluidity improver, from 0.01 part by mass to 5 parts by mass, and more preferably from 0.1 part by mass to 3 parts by mass, based on 100 parts by mass of the magnetic toner base particles.

A preferred fluidity improver is a fine powder produced by vapor phase oxidation of a silicon halide, which is called dry-process silica or fumed silica. For example, such silica is one which utilizes, e.g., heat decomposition oxidation reaction in oxygen-and-hydrogen of silicon tetrachloride gas. The reaction basically proceeds in the following scheme (3) as shown below:

$$SiCl_4+2H_2+O_2 \rightarrow SiO_2+4HCl \quad (3).$$

In this production step, it is also possible to use other metal halide such as aluminum chloride or titanium chloride together with the silicon halide to obtain a composite fine powder of silica with other metal oxide. The fine silica powder used as the fluidity improver in the present invention includes such a composite fine powder as well. As to its particle diameter, it may preferably have average primary particle diameter within the range of from 0.001 μm to 2 μm, and particularly preferably within the range of from 0.002 μm to 0.2 μm.

Commercially available fine silica powders produced by the vapor phase oxidation of silicon halides may include, e.g., those which are on the market under the following trade names, i.e., AEROSIL 130, 200, 300, 380, TT600, MOX170, MOX80, COK84 (Aerosil Japan, Ltd.); Ca-O-SiL M-5, MS-7, MS-75, HS-5, EH-5 (CABOT Co.); WACKER HDK N20, V15, N20E, T30, T40 (WACKER-CHEMIE GMBH); D-C Fine Silica (Dow-Corning Corp.); and FRANSOL (Franzil Co.).

In the present invention, it is preferable for the fine silica powder to have been subjected to hydrophobic treatment. The fine silica powder may be fine silica powder having been so treated that its hydrophobicity as measured by a methanol titration test shows a value within the range of from 30 to 80 degrees. Such a fine silica powder is particularly preferred in order to control wettability of the magnetic toner. The hydrophobicity is expressed as volume percentage of methanol in a liquid mixture of methanol and water that is formed when methanol is dropwise added to a stated quantity of fine silica powder kept stirred in water and the fine silica powder has finished settling.

As a method for making the fine silica powder hydrophobic, a method is available in which, e.g., the fine silica powder is chemically treated with an organosilicon compound or silicone oil capable of reacting with the fine silica powder or physically adsorptive on fine silica particles. Preferred is hydrophobic treatment with an organosilicon compound. Herein, the organosilicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and having a hydroxyl group bonded to each Si in its units positioned at the terminals. Any of these may be used alone or in the form of a mixture of two or more types.

In the hydrophobic treatment of the fine silica powder, among the above organosilicon compounds, one or two or more types of silane coupling agents further having a nitrogen atom may be used. Such a nitrogen-containing silane coupling agent may include, e.g., aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropylmonomethoxysilane, dimethylaminophenyltriethoxysilane, trimethoxylsilyl-γ-propylphenylamine, and trimethoxylsilyl-γ-propylbenzylamine.

In the present invention, as a preferred silane coupling agent, it may include hexamethyldisilazane (HMDS).

As the silicone oil that may also preferably used for the hydrophobic treatment of the fine silica powder, it may preferably have a viscosity at 25° C. of from 0.5 to 10,000 $mm^2/s$ (centistokes), more preferably from 1 to 1,000 $mm^2/s$, and still more preferably from 10 to 200 $mm^2/s$. As a particularly preferred silane coupling agent, it may include, e.g., dimethylsilicone oil, methylphenylsilicone oil, α-methylstyrene modified silicone oil, chlorophenylsilicone oil, and fluorine modified silicone oil.

As methods for the fine silica powder surface hydrophobic treatment making use of the silicone oil, available are, e.g., a method in which the fine silica powder treated with a silane coupling agent and the silicone oil are directly mixed by means of a mixing machine such as a Henschel mixer; a method in which the silicone oil is sprayed on the fine silica powder serving as a base; and a method in which the silicone oil is first dissolved or dispersed in a suitable solvent, and then the fine silica powder is added thereto, followed by removal of the solvent.

In the case when the surface hydrophobic treatment of the fine silica powder is carried out using the silicone oil, it is more preferable that the fine silica powder having been treated with the silicone oil is heated to 200° C. or more (preferably 250° C. or more) in an inert gas to make surface coatings stable.

In the present invention, both the silane coupling agent and the silicone oil as described above may be used in the surface hydrophobic treatment of the fine silica powder. As methods for such surface hydrophobic treatment, available are a method in which the fine silica powder is beforehand treated with the silane coupling agent and thereafter treated with the silicone oil, and a method in which the fine silica powder is simultaneously treated with the silane coupling agent and the silicone oil.

An external additive other than the fluidity improver may further optionally be added to the magnetic toner of the present invention.

For example, in order to, e.g., control the compressibility, inorganic or organic closely spherical fine particles having a number average particle diameter of more than 30 nm, and more preferably a number average particle diameter of from 80 nm to 1 μm, may further be added to the magnetic toner base particles. This is also one of preferred embodiments. For example, spherical silica particles, spherical polymethyl silsesquioxane particles or spherical resin particles may preferably be used.

Such addition of two or more types of inorganic fine powders having different particle diameters enables the magnetic toner easily to have a proper compressibility, as being preferable.

Other additives may further be used, which may include, e.g., lubricant powders such as polyethylene fluoride powder, zinc stearate powder and polyvinylidene fluoride powder; abrasives such as cerium oxide powder, silicon carbide powder and strontium titanate powder; anti-caking agents; conductivity-providing agents such as carbon black, zinc oxide powder and tin oxide powder; and developability improvers such as reverse-polarity organic particles and inorganic particle, which may be added in a small quantity. These additives may also be used after hydrophobic treatment of their particle surfaces.

Such external additives as described above may each be used in an amount of from 0.1 part by mass to 3 parts by mass, and preferably from 0.1 part by mass to 2 parts by mass based on 100 parts by mass of the magnetic toner base particles, which is preferable in view of fixing performance and charge characteristics.

How to measure various physical properties in the present invention is described below in detail.

(1) Measurement of Compressibility of Toner:

The apparent density and tap density of the magnetic toner of the present invention are measured in the following way, using Powder Tester (manufactured by Hosokawa Micron Corporation).

The magnetic toner is uniformly fed from above for 30 seconds through a sieve of 608 μm in mesh opening (24 meshes) into a cylindrical container of 5.03 cm in diameter, 5.03 cm in height and 100 $cm^3$ in volume. At this point, its feed rate is so controlled that the cylindrical container may sufficiently be filled with the toner in 30 seconds. Immediately after the toner has been fed for 30 seconds, the toner is leveled with a blade at the top of the cylindrical container, where the toner in the cylindrical container is weighed to find the apparent density ($g/cm^3$) from the value of toner weight× 1/100. This is operated five times, and an average value is termed as the apparent density ($g/cm^3$) in the present invention.

After the apparent density has been measured, a cylindrical cap is fitted to the cylindrical container, and the powder is filled therein up to its top edge, which is then tapped 180 times at a tapping height of 1.8 cm. After the tapping is finished, the cap is taken off. Then, the toner is leveled with a blade at the top of the container, and the toner in the container is weighed to find the tap density ($g/cm^3$) from the value of toner weight× 1/100. This is operated five times, and an average value is termed as the tap density ($g/cm^3$) in the present invention.

The compressibility is found from:

$$\text{Compressibility}=\{1-(\text{apparent density}/\text{tap density})\}\times 100\%.$$

(2) Measurement of Volume-Base Median Diameter (D50) of Boron Nitride Particles:

The volume-base median diameter (D50) of the boron nitride particles used in the present invention is measured according to JIS Z 8825-1 (2001). Stated specifically, it is measured in the following way. As a measuring instrument, a laser diffraction/scattering particle size distribution measuring instrument "LA-920" (manufactured by Horiba Ltd.) is used. Measuring conditions are set and measured data are analyzed both using a software "HORIBA LA-920 for Windows WET (LA-920) Ver. 2.02" attached to LA-920 for its exclusive use. As a measuring solvent, ion-exchanged water is used, from which impurity solid matter and so forth have previously been removed.

Measuring procedure is as follows.

1) A batch-type cell holder is attached to LA-920.

2) The ion-exchanged water is put into a batch-type cell in a stated quantity, and this batch-type cell is set in the batch-type cell holder.

3) What is held in the batch-type cell is stirred by means of a stirrer tip for its exclusive use.

4) A "Refractive Index" button is touched on a "Display Condition Setting" screen, to chose a file "110A000I" (relative refractive index: 1.10).

5) On the "Display Condition Setting" screen, particle diameter base is changed to volume base.

6) Warming up is carried out for 1 hour or more, and thereafter an optical axis is adjusted, the optical axis is micro-adjusted and a blank is measured.

7) About 60 ml of the ion-exchanged water is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass.

8) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into an water tank of the ultrasonic dispersion machine, about 3.3 liters of ion-exchanged water is put, and about 2 ml of the above CONTAMINON N is added to this water tank.

9) The beaker of the above 7) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

10) In the state the aqueous solution in the beaker of the above 9) is irradiated with ultrasonic waves, about 1 mg of the boron nitride particles are little by little added to the aqueous solution and is dispersed therein. Then, such ultrasonic dispersion treatment is further continued for 60 seconds. Here, the boron nitride particles may come to float on liquid surface in the form of masses. If it occurs, the beaker may be swung to make the masses settle in the water, followed by the above ultrasonic dispersion treatment for 60 seconds. Also, in carrying out the ultrasonic dispersion treatment, the water temperature of the water tank is appropriately so controlled as to be 10° C. or more to 40° C. or less.

11) The aqueous solution in which the boron nitride particles stand dispersed as prepared in the above 10) is immediately little by little added to the batch-type cell while taking care that no air bubbles may mix therein, until it come to be 90% to 95% in transmittance of light of a tungsten lamp. Then, particle size distribution is measured. On the basis of the data obtained on volume-base particle size distribution, the volume-base median diameter (D50) and coefficient of variation are calculated.

Coefficient of variation=[particle diameter standard deviation σ/median diameter ($D$50)×100(%)]

(3) Measurement of Weight Average Particle Diameter (D4) and Number Average Particle Diameter (D1) of toner:

The weight average particle diameter (D4) and number average particle diameter (D1) of the toner are measured in the following way. A precision particle size distribution measuring instrument "Coulter Counter Multisizer 3" (registered trade mark; manufactured by Beckman Coulter, Inc.) is used as a measuring instrument, which has an aperture tube of 100 μm in size and employing the aperture impedance method. A software "Beckman Coulter Multisizer 3 Version 3.51" (produced by Beckman Coulter, Inc.) attached to Multisizer 3 for its exclusive use is also used, which is to set the conditions for measurement and analyze the data of measurement. The measurement is made through 25,000 channels as effective measuring channels in number.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Here, before the measurement and analysis are made, the software for exclusive use is set in the following way.

On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked.

On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

1) About 200 ml of the aqueous electrolytic solution is put into a 250 ml round-bottomed beaker made of glass for exclusive use in Multisizer 3 and this is set on a sample stand, where stirring with a stirrer rod is carried out at 24 revolutions/second in the anticlockwise direction. Then, "Flash of Aperture" function of the analysis software is operated to beforehand remove any dirt and air bubbles in the aperture tube.

2) About 30 ml of the aqueous electrolytic solution is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass.

3) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into a water tank of the ultrasonic dispersion machine, a stated amount of ion-exchanged water is put, and about 2 ml of the above CONTAMINON N is added to this water tank.

4) The beaker of the above (2) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

5) In the state the aqueous electrolytic solution in the beaker of the above (4) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

6) To the round-bottomed beaker of the above (1), placed inside the sample stand, the aqueous electrolytic solution in which the toner has been dispersed in the above (5) is dropwise added by using a pipette, and the measuring concentration is so adjusted as to be about 5%. Then the measurement is made until the measuring particles come to 50,000 particles in number.

7) The data of measurement are analyzed by using the above software attached to the measuring instrument for its exclusive use, to calculate the weight average particle diameter (D4) and number average particle diameter (D1). Here, "Average Diameter" on an "Analysis/Volume Statistic Value (Arithmetic Mean)" screen when set to graph/% by volume in the software for exclusive use is the weight average particle diameter (D4), and "Average Diameter" on an "Analysis/Number Statistic Value (Arithmetic Mean)" screen when set to graph/% by number in the software for exclusive use is the number average particle diameter (D1).

(4) Measurement of Average Circularity of Toner:

The average circularity of the toner is measured with a flow type particle analyzer "FPIA-2100" (manufactured by Sysmex Corporation). Details are as follows:

First, circularity is calculated according to the following expression.

Circularity=(circumferential length of a circle with the same area as particle projected area)/(circumferential length of particle projected image).

Herein, the "particle projected area" is defined as the area of a binary-coded toner particle image, and the "circumferential length of particle projected image" is defined as the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.00 when the toner particles are perfectly spherical. The more complicate the surface shape is, the smaller the value of circularity is.

Average circularity C which means an average value of circularity frequency distribution is calculated from the following expression (1) where the circularity at a partition point i of particle size distribution is represented by ci, and the number of particles measured by m.

$$\text{Average circularity } C = \sum_{i=1}^{m} ci/m. \quad (1)$$

Particle diameter standard deviation SD is calculated from the following expressions (2) where the average circularity is represented by C, the circularity in each particle by ci, and the number of particles measured by m.

$$\text{Particle diameter standard deviation } SD = \left\{\sum_{i=1}^{m} (C - ci)^2/m\right\}^{1/2}$$

A specific way of measurement is as follows: First, about 10 ml of ion-exchanged water, from which impurity solid matter and the like have beforehand been removed, is put into a container made of glass. To this water, about 0.1 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Further, about 0.02 g of a measuring sample is added, followed by dispersion treatment for 2 minutes by means of an ultrasonic dispersion machine to prepare a liquid dispersion for measurement. As the ultrasonic dispersion machine, an ultrasonic dispersion machine of 120 W in electric output "Ultrasonic Dispersion system TETORA 150 Model" (manufactured by Nikkaki Bios Co.) is used, having two oscillators of 50 kHz in oscillation frequency which are built therein in the state their phases are shifted by 180 degrees. Into an water tank of the ultrasonic dispersion machine, a stated amount of ion-exchanged water is put, and about 2 ml of the above CONTAMINON N is added to this water tank. In that case, the liquid dispersion is appropriately cooled so that its temperature does not become 40° C. or more. Also, in order to keep the circularity from scattering, the flow type particle analyzer FPIA-2100 is installed in an environment controlled to 23° C.±0.5° C. so that its in-machine temperature can be kept at 26° C. to 27° C. Still also, autofocus control is performed using 2 μm standard latex particles (e.g., "RESEARCH AND TEST PARTICLES Latex Microsphere Suspensions 5200A, available from Duke Scientific Corporation) at intervals of constant time, and preferably at intervals of 2 hours.

In measuring the circularity of the toner particles, the above flow type particle analyzer is used and PARTICLE SHEATH PSE-900A (available from Sysmex Corporation) is used as a sheath solution. The liquid dispersion having been controlled according to the above procedure is introduced into the flow type particle analyzer FPIA-2100, where the concentration of the liquid dispersion is again so controlled that the toner particle concentration at the time of measurement may be about 5,000 particles/μl. After the measurement, using the data obtained, the average circularity of toner particles with a circle-equivalent diameter of from 2.00 μm or more to less than 40.02 μm is determined. Here, the circle-equivalent diameter is the value calculated according to the following expression.

$$\text{Circle-equivalent diameter} = (\text{particle projected area}/n)^{1/2} \times 2.$$

The measuring instrument "FPIA-2100" used in the present invention is, compared with "FPIA-1000" having ever been used to observe the shape of toner particles, an instrument having succeeded in making its sheath flow more thin-layer (7 μm→4 μm) and improved in magnification of processed particle images. It is also an instrument having been improved in processing resolution of images captured (256×256→512×512), and is an instrument having been improved in precision of measurement of toner particle shapes.

EXAMPLES

The present invention is described below in greater detail by giving production examples and working examples, which, however, by no means limit the present invention. In the following formulation, "part(s)" refers to part(s) by mass in all occurrences.

Magnetic Iron Oxide

Production Example 1

In an aqueous ferrous sulfate solution, a sodium hydroxide solution (containing 1% by mass of sodium hexametaphosphate in terms of P based on Fe) was mixed in an equivalent weight of from 1.0 to 1.1 based on iron ions, to prepare an aqueous solution which contained ferrous hydroxide. Maintaining the pH of the aqueous solution at 9, air was blown into it to effect oxidation reaction at 80° C. to 90° C. to prepare a slurry fluid from which seed crystals were to be formed.

Next, to this slurry fluid, an aqueous ferrous sulfate solution was so added as to be in an equivalent weight of from 0.9 to 1.2 based on the initial alkali content (the sodium component in the sodium hydroxide). Thereafter, maintaining the pH of the slurry fluid at 8, oxidation reaction was carried on while air was blown into it. At the termination of the oxidation reaction, the pH was adjusted to about 6, and then a silane coupling agent n-$C_8H_{17}Si(OC_2H_5)_3$ was added thereto in an amount of 2.0 parts based on 100 parts by mass of the magnetic iron oxide, followed by thorough stirring. The hydrophobic iron oxide particles thus formed were washed, filtered and then dried by conventional methods, followed by disintegration treatment of particles standing agglomerate, to obtain Magnetic Iron Oxide 1. This Magnetic Iron Oxide 1 was 0.28 μm in number average particle diameter, and 68.0 $Am^2/kg$ (emu/g) and 3.0 $Am^2/kg$ (emu/g) in saturation magnetization and residual magnetization, respectively, in a magnetic field of 79.6 kA/m (1,000 oersteds).

Magnetic Iron Oxide

Production Examples 2 & 3

Magnetic Iron Oxides 2 and 3 were obtained in the same way as the above except that, as shown in Table 6, the magnetic properties of the magnetic iron oxides were changed and the surface treatment with the silane coupling agent was carried out or not.

Production of Magnetic Toner A

Into 709 parts by mass of ion-exchanged water, 451 parts of an aqueous 0.1 mol/liter $Na_3PO_4$ solution was introduced, followed by heating to 60° C. Thereafter, 67.7 parts of an aqueous 1.0 mol/liter $CaCl_2$ solution was slowly added thereto to obtain an aqueous medium containing $Ca_3(PO_4)_2$.

Meanwhile, materials formulated as below were uniformly dispersed and mixed by means of an attritor (manufactured by Mitsui Miike Engineering Corporation) to prepare a monomer composition.

| | |
|---|---|
| Styrene | 80 parts |
| n-Butyl acrylate | 20 parts |
| Saturated polyester resin (monomer makeup: bisphenol-A propylene oxide addition product/terephthalic acid; acid value: 12 mgKOH/g; Tg (glass transition temperature): 72° C.; Mn (number-average molecular weight): 3,900; Mw (weight-average molecular weight): 10,000) | 6 parts |
| Negative charge control agent (T-77, a monoazo dye type Fe compound, available from Hodogaya Chemical Co., Ltd.) | 3 parts |
| Magnetic Iron Oxide 1 | 95 parts |

This monomer composition was heated to 63° C., and 8 parts of HNP-9 (paraffin wax; DSC endothermic main peak: 78° C.), available from Nippon Seiro Co., Ltd., was mixed and dissolved therein. In the mixture obtained, 4 parts of a polymerization initiator butyl peroxide was dissolved to obtain a polymerizable monomer composition.

This polymerizable monomer composition was introduced into the above aqueous medium, and these were stirred at 60° C., and for 15 minutes at 15,000 rpm by means of CLEAMIX (manufactured by $M_{TECHNIQUE}$ Co., Ltd.) in an atmosphere of $N_2$ to carry out granulation. Thereafter, the granulated product obtained was stirred with a paddle stirring blade, during which the reaction was carried out at 68° C. for 1 hour. Thereafter, the stirring was further continued for 6 hours. Thereafter, water vapor was introduced into the reaction system and, after lapse of 3 hours, the suspension formed was cooled, where hydrochloric acid was added thereto to dissolve the $Ca_3(PO_4)_2$, followed by filtration, water washing and then drying. The powder thus formed was classified by means of an air classifier to obtain magnetic toner base particles a.

100 parts by mass of the magnetic toner base particles a thus obtained, 1.0 part of hydrophobic fine silica powder treated with hexamethyldisilazane and thereafter treated with silicone oil and having a BET specific surface area of 160 $m^2/g$ after treatment, 0.5 part of boron nitride particles 1 as shown in Table 7 and 0.5 part of an external additive 2 as shown in Table 8 were mixed by means of Henschel mixer (manufactured by Mitsui Miike Engineering Corporation) to obtain Magnetic Toner A. Physical properties of this Magnetic Toner A are shown in Table 10.

Production of Magnetic Toners B & C

Magnetic toner base particles b and c were obtained in the same way as in Production of Magnetic Toner A except that, after the polymerizable monomer composition was reacted, the time for which the water vapor was introduced was changed to 1 hour and 5 hours, respectively. Thereafter, external additives shown in Table 9 were used to obtain Magnetic Toners B & C. Physical properties of these Magnetic Toners B and C are shown in Table 10.

Production of Magnetic Toners D to M

Magnetic Toners D to M were obtained in the same way as Magnetic Toner A except that magnetic materials and external additives were used as shown in Table 9 and the amount of $Ca_3(PO_4)_2$ added was controlled to change the particles diameters of toners. Physical properties of Magnetic Toners D to M are shown in Table 10.

Production of Magnetic Toner N (Production of Binder Resin)

| | |
|---|---|
| Terephthalic acid | 27 mol % |
| Adipic acid | 15 mol % |
| Trimellitic acid | 6 mol % |
| Bisphenol derivative represented by Formula (a) above (propylene oxide 2.5 mol addition product) | 35 mol % |
| Bisphenol derivative represented by Formula (a) above (ethylene oxide 2.5 mol addition product) | 17 mol % |

The polyester monomers shown above and an esterification catalyst were introduced into a four-necked flask, and a vacuum device, a water separator, a nitrogen gas feeder, a temperature measuring device and a stirrer were fitted thereto, where the reaction was carried out in an atmosphere of nitrogen and with heating to 230° C. After the reaction was completed, the product formed was taken out of the flask, then cooled, and thereafter pulverized to obtain Resin A having a softening point of 143° C.

Next;

| | |
|---|---|
| Terephthalic acid | 24 mol % |
| Adipic acid | 16 mol % |
| Trimellitic acid | 10 mol % |
| Bisphenol derivative represented by Formula (a) above (propylene oxide 2.5 mol addition product) | 30 mol % |
| Bisphenol derivative represented by Formula (a) above (ethylene oxide 2.5 mol addition product) | 20 mol % |

The polyester monomers shown above and an esterification catalyst were introduced into a four-necked flask, and a vacuum device, a water separator, a nitrogen gas feeder, a temperature measuring device and a stirrer were fitted thereto, where the reaction was carried out in an atmosphere of nitrogen and with heating to 230° C. After the reaction was completed, the product formed was taken out of the flask, then cooled, and thereafter pulverized to obtain Resin B having a softening point of 98° C.

50 parts each of Resins A and B were mixed by means of Henschel mixer to prepare Binder Resin 1. This Binder Resin 1 was one having a glass transition temperature of 59° C. and a softening point of 128° C. and containing 43% of a component of 10,000 or less in molecular weight as measured by gel permeation chromatography.

| | |
|---|---|
| Binder resin 1 | 100 parts |
| Magnetic Iron Oxide 3 | 90 parts |
| Monoazo iron complex (T-77, available from Hodogaya Chemical Co., Ltd.) | 1 part |
| Fischer-Tropsch wax (melting point: 100° C.; FT100, available from Nippon Seiro Co., Ltd.) | 5 parts |

A mixture of the above was premixed by means of Henschel mixer, and thereafter melt-kneaded by means of a twin-screw extruder heated to 110° C., to obtain a kneaded product. This was cooled and the kneaded product cooled was crushed by using a hammer mill to obtain a crushed product. The crushed product obtained was finely pulverized by mechanical grinding by means of a mechanical grinding machine Turbo mill (manufactured by Turbo Kogyo Co., Ltd.; the surfaces of its rotator and stator were coated by plating of a chromium alloy containing chromium carbide; plating thickness: 150 μm; surface hardness: HV 1,050). The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. The toner base particles obtained there had a weight average particle diameter (D4) of 7.2 μm as measured by the Coulter Counter method.

The raw-material toner base particles obtained were subjected to surface modification by using METEO RAINBOW MR-3 Model (manufactured by Nippon Pneumatic Mfg. Co., Ltd.), an apparatus for surface-modifying toner base particles by spraying hot air. The surface modification was carried out under conditions of a raw-material feed rate of 2 kg/hr, a hot air flow rate of 700 L/min and a jet-out hot-air temperature of 200° C.

100 parts by mass of the magnetic toner base particles thus obtained, 1.0 part of hydrophobic fine silica powder treated with hexamethyldisilazane and thereafter treated with silicone oil and having a BET specific surface area of 160 $m^2/g$ after treatment, 0.2 part of boron nitride particles 3 as shown in Table 7 and 0.3 part of an external additive 2 as shown in Table 8 were mixed by means of Henschel mixer (manufactured by Mitsui Miike Engineering Corporation) to obtain Magnetic Toner N. Physical properties of this Magnetic Toner N are shown in Table 10.

Production of Comparative Magnetic Toners a to d

Comparative Magnetic Toners a to d were obtained in the same way as in Production of Magnetic Toner A except that magnetic materials and external additives were changed as shown in Table 9, further changing the particles diameters of toners. Physical properties of Comparative Magnetic Toners a to d are shown in Table 10.

Production of Comparative Magnetic Toner e

Comparative Magnetic Toner e was obtained in the same way as in Production of Magnetic Toner N except that magnetic materials and external additives were changed as shown in Table 9, further changing the particles diameters of toners. Physical properties of Comparative Magnetic Toner e are shown in Table 10.

Example 1

Using a commercially available copying machine iR3570, manufactured by CANON INC., in which Magnetic Toner A was filled, evaluation was made in the following way.

A 50,000-sheet paper feed running test was conducted in a normal-temperature low-humidity environment (N/L; temperature: 23° C.; humidity: 5% RH). A chart with an image percentage of 5% was used as an original. Thereafter, another 50,000-sheet paper feed running test was conducted in a high-temperature high-humidity environment (H/H; temperature: 30° C.; humidity: 80% RH). Here, the evaluation was made on image density, fog, digital-image sharpness, developing sleeve stain level and photosensitive member toner melt adhesion/faulty cleaning at the initial stage of and/or after running, and according to criteria shown below.

Image Evaluation

1. Image Density:

To evaluate the image density, solid images were formed over the whole area of printing paper at the initial stage of and after 50,000-sheet paper feed running tested in the normal-temperature low-humidity environment (N/L; temperature: 23° C.; humidity: 5% RH), and at the initial stage of and after 50,000-sheet paper feed running tested in the high-temperature high-humidity environment (H/H; temperature: 30° C.; humidity: 80% RH). The reflection density of the solid images thus formed was measured with Macbeth densitometer (manufactured by Gretag Macbeth Ag), using an SPI filter.

2. Fog:

As to the fog, after 50,000-sheet paper feed running tested in the normal-temperature low-humidity environment (N/L; temperature: 23° C.; humidity: 5% RH), the reflectance at white areas of the above images and that of virgin paper were measured with a reflectance measuring instrument for fog measurement REFLECTOMETER (manufactured by Tokyo Denshoku Co., Ltd.), and the difference between the both was regarded as the fog.

[Fog(%)=(reflectance of virgin paper)−(reflectance at image white areas)].

A: Fog is less than 0.3%.
B: Fog is 0.3% to less than 1.0%.
C: Fog is 1.0% to less than 2.0%.
D: Fog is 2.0% to less than 2.5%.
E: Fog is 2.5% or more.

3. Digital-Image Sharpness:

Using an original having lines and characters, images formed after 50,000-sheet paper feed running tested in the normal-temperature low-humidity environment (N/L) and images formed after 50,000-sheet paper feed running tested in the high-temperature high-humidity environment (H/H) were observed visually and using a magnifying microscope to make evaluation according to the following criteria.

A: Both the lines and the characters stand reproduced faithfully up to details.
B: Disorder or toner scatter is seen to have more or less come about, but at a level of no problem in visual observation.
C: Disorder or toner scatter is seen at a level perceivable even in visual observation.
D: Disorder or toner scatter is seen to have come about in a large number, and the original is not reproduced.

4. Developing Sleeve Stain Level:

The developing sleeve standing after 50,000-sheet paper feed running tested in the high-temperature high-humidity environment (H/H; temperature: 30° C.; humidity: 80% RH) was visually observed to make evaluation on its stain level according to the following criteria.

A: No problem on both the sleeve and the images.
B: Stain is somewhat seen at some part on the sleeve, but no problem on the images.
C: Stain is seen at some part on the sleeve, and density decrease or the like comes about at some part on the images.
D: Stain is seen on the whole sleeve, and density decrease or the like comes about on the whole images.

5. Photosensitive Member Toner Melt Adhesion/Faulty Cleaning:

A 10,000-sheet paper feed running test was also conducted in a normal-temperature normal-humidity environment (N/N; temperature: 23° C.; humidity: 50% RH), changing to +30% and −30% each the pressure set for the cleaning blade against the photosensitive member of iR3570. The level at which any toner melt adhesion and faulty cleaning came about on the photosensitive member was examined to make evaluation according to the following criteria.

A: Any toner melt adhesion and faulty cleaning is not seen at all to have come about on the photosensitive member.

B: Toner melt adhesion is seen on the photosensitive member, but has little affected the images to be formed.

C: Faulty images due to toner melt adhesion or faulty cleaning are seen at either of the cleaning blade pressures of +30% and −30%.

D: Faulty images due to toner melt adhesion or faulty cleaning are seen at both of the cleaning blade pressures of +30% and −30%.

As the result, good results were obtained as shown in Table 11.

Examples 2 to 14

Evaluation was made in the same way as in Example 1, but using Magnetic Toners B to N, respectively. As the result, good results were obtained as shown in Table 11.

Comparative Examples 1 to 5

Evaluation was made in the same way as in Example 1, but using Comparative Magnetic Toners a to e, respectively. As the result, results as shown in Table 11 were obtained.

TABLE 6

| Magnetic material No. | Number average particle diam. (μm) | Magnetic properties: Saturation magnetization ($Am^2/kg$) | Magnetic properties: Residual magnetization ($Am^2/kg$) | Coupling agent: Type | Coupling agent: Amt. (pbm) |
|---|---|---|---|---|---|
| Magnetic Iron Oxide 1 | 0.24 | 68.0 | 3.0 | $n\text{-}C_8H_{17}Si(OC_2H_5)_3$ | 2.0 |
| Magnetic Iron Oxide 2 | 0.20 | 68.5 | 8.6 | $n\text{-}C_8H_{17}Si(OC_2H_5)_3$ | 2.0 |
| Magnetic Iron Oxide 3 | 0.25 | 67.3 | 3.2 | None | None |

TABLE 7

| | Median diameter (D50) | Coefficient of variation |
|---|---|---|
| Boron nitride particles 1 | 5.1 μm | 42 |
| Boron nitride particles 2 | 4.8 μm | 75 |
| Boron nitride particles 3 | 2.3 μm | 61 |
| Boron nitride particles 4 | 6.8 μm | 58 |
| Boron nitride particles 5 | 0.8 μm | 82 |
| Boron nitride particles 6 | 8.8 μm | 66 |

TABLE 8

| External additive No. | Material | Number average particle diameter |
|---|---|---|
| External additive 1 | Sol-gel process silica treated with hexamethyldisilazane | 100 nm |
| External additive 2 | Strontium titanate treated with stearic acid | 120 nm |
| External additive 3 | Strontium titanate | 0.8 μm |

TABLE 9

| Magnetic toner | Production process | Magnetic toner base particles | Magnetic material: Magnetic iron oxide No. | Magnetic material: Magnetic iron oxide Amt. | Inorganic fine powders added externally to toner base particles: Boron nitride particles | Amt. | Type (1) | Amt. | Type (2) | Amt. |
|---|---|---|---|---|---|---|---|---|---|---|
| A | Sus. polymzn | a | 1 | 90 | 1 | 0.2 | Hydrophobic-treated silica | 1.0 | External additive 2 | 0.3 |
| B | Sus. polymzn | b | 1 | 90 | 1 | 0.2 | Hydrophobic-treated silica | 1.0 | External additive 2 | 0.3 |

TABLE 9-continued

| Magnetic toner | Production process | Magnetic toner base particles | Magnetic material: Magnetic iron oxide No. | Magnetic material: Magnetic iron oxide Amt. | Inorganic fine powders added externally to toner base particles: Boron nitride particles | Boron nitride Amt. | Type (1) | Amt. | Type (2) | Amt. |
|---|---|---|---|---|---|---|---|---|---|---|
| C | Sus .polymzn | C | 1 | 90 | 1 | 0.2 | Hydrophobic-treated silica | 1.0 | External additive 2 | 0.3 |
| D | Sus. polymzn | b | 1 | 90 | 2 | 0.2 | Hydrophobic-treated silica | 1.0 | External additive 3 | 0.5 |
| E | Sus. polymzn | b | 1 | 90 | 3 | 0.2 | Hydrophobic-treated silica | 1.0 | External additive 3 | 0.5 |
| F | Sus. polymzn | b | 1 | 90 | 4 | 0.2 | Hydrophobic-treated silica | 1.0 | External additive 3 | 0.5 |
| G | Sus. polymzn | b | 1 | 90 | 5 | 0.2 | Hydrophobic-treated silica | 1.0 | External additive 3 | 0.5 |
| H | Sus. polymzn | c | 1 | 90 | 3 | 0.08 | Hydrophobic-treated silica | 1.0 | External additive 3 | 0.5 |
| I | Sus. polymzn | c | 1 | 90 | 3 | 0.8 | Hydrophobic-treated silica | 1.0 | External additive 1 | 0.1 |
| J | Sus. polymzn | d | 2 | 90 | 3 | 0.2 | Hydrophobic-treated silica | 1.0 | External additive 2 | 0.3 |
| K | Sus. polymzn | e | 2 | 100 | 3 | 0.5 | Hydrophobic-treated silica | 1.5 | External additive 2 | 0.5 |
| L | Sus. polymzn | f | 2 | 80 | 3 | 0.1 | Hydrophobic-treated silica | 0.6 | External additive 2 | 0.2 |
| M | Sus. polymzn | f | 2 | 80 | 3 | 0.1 | Hydrophobic-treated silica | 0.6 | — | — |
| N | Pulverizatn | g | 3 | 90 | 3 | 0.2 | Hydrophobic-treated silica | 1.0 | External additive 2 | 0.3 |
| a | Sus. polymzn | h | 1 | 90 | 2 | 0.1 | Hydrophobic-treated silica | 1.0 | External additive 2 | 0.3 |
| b | Sus. polymzn | b | 1 | 90 | 2 | 0.01 | Hydrophobic-treated silica | 1.0 | External additive 2 | 0.3 |
| c | Sus. polymzn | b | 1 | 90 | 2 | 1.5 | Hydrophobic-treated silica | 1.0 | External additive 2 | 0.3 |
| d | Sus. polymzn | b | 1 | 90 | 6 | 0.3 | Hydrophobic-treated silica | 1.0 | External additive 2 | 0.3 |
| e | Pulverizatn | i | 3 | 90 | 3 | 0.2 | Hydrophobic-treated silica | 1.0 | External additive 2 | 0.3 |

Sus. polymzn: Suspension polymerization; Amt.: Amount (part(s) by mass)

TABLE 10

| Toner | Toner particle diameter: Weight average particle diameter (μm) | Toner particle diameter: Weight average particle diameter/number average particle diameter | Average circularity | Compressibility | Residual magnetization of magnetic toner ($Am^2/kg$) |
|---|---|---|---|---|---|
| Magnetic Toner A | 7.0 | 1.14 | 0.969 | 26 | 1.6 |
| Magnetic Toner B | 7.2 | 1.16 | 0.964 | 23 | 1.6 |
| Magnetic Toner C | 6.8 | 1.12 | 0.974 | 28 | 1.6 |
| Magnetic Toner D | 7.2 | 1.16 | 0.970 | 23 | 1.6 |
| Magnetic Toner E | 7.2 | 1.16 | 0.972 | 23 | 1.6 |
| Magnetic Toner F | 7.2 | 1.16 | 0.973 | 23 | 1.6 |
| Magnetic Toner G | 7.2 | 1.16 | 0.969 | 23 | 1.6 |
| Magnetic Toner H | 6.8 | 1.12 | 0.974 | 29 | 1.6 |
| Magnetic Toner I | 6.8 | 1.12 | 0.974 | 25 | 1.6 |
| Magnetic Toner J | 7.1 | 1.15 | 0.969 | 23 | 3.6 |
| Magnetic Toner K | 5.2 | 1.28 | 0.970 | 28 | 4.2 |
| Magnetic Toner L | 8.6 | 1.14 | 0.969 | 29 | 3.2 |
| Magnetic Toner M | 7.2 | 1.15 | 0.970 | 30 | 3.6 |
| Magnetic Toner N | 7.2 | 1.20 | 0.958 | 27 | 1.6 |
| | | Comparative: | | | |
| Magnetic Toner a | 7.3 | 1.20 | 0.944 | 34 | 1.6 |
| Magnetic Toner b | 7.2 | 1.16 | 0.964 | 26 | 1.6 |
| Magnetic Toner c | 7.2 | 1.16 | 0.964 | 23 | 1.6 |
| Magnetic Toner d | 7.2 | 1.16 | 0.964 | 25 | 1.6 |
| Magnetic Toner e | 7.3 | 1.29 | 0.934 | 36 | 1.6 |

TABLE 11

| | | 1. Image density | | | | 2. Fog | | 3. Digital-image sharpness | | | 50k: 50,000 |
|---|---|---|---|---|---|---|---|---|---|---|---|
| | | N/L | | H/H | | (N/L) | | N/L: | H/H: | | 5. Toner melt |
| | Toner | Initial stg. | After 50k sh. | Initial stg. | After 50k sh. | Initial stg. | After 50k sh. | After 50k sh. | After 50k sh. | 4. Sleeve stain | adhesion/faulty cleaning |
| Example: | | | | | | | | | | | |
| 1 | Mag. Toner A | 1.52 | 1.48 | 1.47 | 1.40 | A | B | A | B | A | A |
| 2 | Mag. Toner B | 1.51 | 1.48 | 1.47 | 1.46 | A | B | A | A | A | A |
| 3 | Mag. Toner C | 1.51 | 1.49 | 1.44 | 1.36 | B | B | B | B | A | A |
| 4 | Mag. Toner D | 1.48 | 1.45 | 1.42 | 1.33 | B | B | B | C | B | B |
| 5 | Mag. Toner E | 1.50 | 1.46 | 1.45 | 1.41 | A | A | A | B | A | A |
| 6 | Mag. Toner F | 1.50 | 1.43 | 1.41 | 1.31 | A | B | B | B | B | B |
| 7 | Mag. Toner G | 1.46 | 1.40 | 1.40 | 1.35 | B | B | B | C | B | B |
| 8 | Mag. Toner H | 1.45 | 1.38 | 1.39 | 1.31 | B | B | B | C | B | C |
| 9 | Mag. Toner I | 1.50 | 1.41 | 1.40 | 1.32 | B | B | B | B | B | C |
| 10 | Mag. Toner J | 1.45 | 1.40 | 1.39 | 1.29 | A | A | B | B | B | B |
| 11 | Mag. Toner K | 1.52 | 1.47 | 1.44 | 1.39 | B | C | A | B | B | B |
| 12 | Mag. Toner L | 1.42 | 1.37 | 1.34 | 1.28 | B | B | B | C | A | B |
| 13 | Mag. Toner M | 1.43 | 1.36 | 1.35 | 1.25 | B | B | B | C | B | C |
| 14 | Mag. Toner N | 1.47 | 1.44 | 1.41 | 1.35 | A | B | B | B | B | B |
| Comparative Example: | | | | | | | | | | | |
| 1 | Mag. Toner a | 1.48 | 1.43 | 1.37 | 1.24 | B | B | C | D | C | C |
| 2 | Mag. Toner b | 1.50 | 1.47 | 1.40 | 1.25 | B | B | B | D | D | D |
| 3 | Mag. Toner c | 1.47 | 1.39 | 1.37 | 1.15 | B | C | C | D | B | C |
| 4 | Mag. Toner d | 1.45 | 1.35 | 1.33 | 1.12 | B | C | C | D | B | C |
| 5 | Mag. Toner e | 1.44 | 1.39 | 1.37 | 1.24 | B | C | C | C | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-301428, filed Nov. 21, 2007, which is hereby incorporated by reference herein in its entirety.

What is claimed is:

1. A magnetic toner which comprises magnetic toner base particles containing at least a binder resin and a magnetic material, and an inorganic fine powder;

(i) the magnetic toner having an average circularity of from 0.950 or more to 1.000 or less;

(ii) the magnetic toner having a compressibility of 30 or less which is found from the following expression (1):

$$\text{Compressibility}=\{1-(\text{apparent density}/\text{tap density})\}\times 100;\text{ and} \qquad \text{Expression (1)}$$

(iii) the magnetic toner containing boron nitride particles having a median diameter (D50) of from 0.5 μm or more to 8.0 μm or less, as the inorganic fine powder in an amount of from 0.05 part by mass or more to 1.00 part by mass or less based on 100 parts by mass of the magnetic toner base particles.

2. The magnetic toner according to claim 1, which has a weight average particle diameter (D4) of from 4.0 μm or more to 9.0 μm or less, and has a ratio of weight average particle diameter (D4) to number average particle diameter (D1) of 1.25 or less.

3. The magnetic toner according to claim 1, wherein the boron nitride particles have a median diameter (D50) of from 1.0 μm or more to 6.0 μm or less, and have a coefficient of variation of 70 or less.

4. The magnetic toner according to claim 1, which contains at least the magnetic toner base particles, the boron nitride particles, and two types of inorganic oxides having different particle diameters.

5. The magnetic toner according to claim 1, which contains at least the magnetic toner base particles, the boron nitride particles, and as inorganic oxides a hydrophobic silica having a specific surface area of from 100 $m^2/g$ to 300 $m^2/g$, in an amount of from 0.1 part by mass to 3 parts by mass based on 100 parts by mass of the magnetic toner base particles, and a metal oxide having a number average particle diameter of from 80 nm to 1 μm, in an amount of from 0.1 part by mass to 3 parts by mass based on 100 parts by mass of the magnetic toner base particles.

6. The magnetic toner according to claim 1, which has a residual magnetization of 4.0 $Am^2/kg$ or less when magnetized in a magnetic field of 79.6 kA/m.

* * * * *